US007118332B2

(12) United States Patent
Horng et al.

(10) Patent No.: US 7,118,332 B2
(45) Date of Patent: Oct. 10, 2006

(54) HEAT DISSIPATING FAN WITH AIR-GUIDING STRUCTURE

(75) Inventors: Alex Horng, Kaohsiung (TW); Yin-Rong Hong, Kaohsiung (TW); Ching-Sheng Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 83 days.

(21) Appl. No.: 10/900,123

(22) Filed: Jul. 28, 2004

(65) Prior Publication Data

US 2005/0042084 A1 Feb. 24, 2005

(30) Foreign Application Priority Data

Jul. 31, 2003 (TW) ..... 92121051 A

(51) Int. Cl.
*F01D 1/04* (2006.01)
*F01D 9/02* (2006.01)

(52) U.S. Cl. ..... 415/208.2; 415/119; 415/211.2; 415/220

(58) Field of Classification Search ..... 415/119, 415/208.2, 211.2, 220, 223, 192, 121.2, 175, 415/176, 178; 416/247 R
See application file for complete search history.

(56) References Cited

U.S. PATENT DOCUMENTS

| | | | | |
|---|---|---|---|---|
| 2,154,313 | A * | 4/1939 | McMahan | 415/210.1 |
| 3,178,099 | A * | 4/1965 | Child | 415/119 |
| 5,466,120 | A * | 11/1995 | Takeuchi et al. | 415/119 |
| 6,244,818 | B1 * | 6/2001 | Chang | 415/208.2 |
| 6,547,540 | B1 * | 4/2003 | Horng et al. | 415/208.2 |
| 6,695,045 | B1 * | 2/2004 | Chang | 361/697 |

* cited by examiner

*Primary Examiner*—Igor Kershteyn
(74) *Attorney, Agent, or Firm*—Bacon & Thomas, PLLC

(57) ABSTRACT

A heat dissipating fan includes a casing having an outlet, a base mounted in the outlet of the casing, and a plurality of air guiding members mounted in the outlet and connected between the base and the casing. Each air guiding member defines at least one air concentrating area for concentrating air, for guiding airflow, and for increasing wind pressure when an impeller mounted on the base turns.

20 Claims, 7 Drawing Sheets

HEAT DISSIPATING FAN WITH AIR-GUIDING STRUCTURE

BACKGROUND OF THE INVENTION

1. Field of the Invention

The present invention relates to a heat dissipating fan. In particular, the present invention relates to a heat dissipating fan with an air-guiding structure.

2. Description of Related Art

FIG. 1 of the drawings illustrates a conventional heat dissipating fan comprising a casing 10, a base 13, and a plurality of ribs 14*a*. The casing 10 includes an inlet 11 and an outlet 12 respectively in two sides thereof. The base 13 is located in the outlet 12 and supported by the ribs 14*a*. A stator (not shown) and an impeller (not shown) are mounted to the base 13. When the impeller turns, air is sucked into the casing 10 via the inlet 11 and outputted via the outlet 12 to dissipate an object such as a fin or a central processing unit.

Although a heat dissipating function is provided, the airflow driven by the heat dissipating fan can only flow along an axial direction of the casing 10 and exit the casing 10 via the outlet 12 to dissipate an object directly below the outlet 12. In a case that the object to be dissipated could not occupy the overall area below the outlet 12, the airflow for dissipating heat could not be effectively used. In another case that the object to be dissipated is located in a limited space such as a notebook type computer, the object may not be located right below the base 13 or in an area surrounding the outlet 12, or the object has a relatively large volume and thus could not be directly located below the heat dissipating fan, the heat dissipating effect is not satisfactory. Further, turbulent is generated when the airflow passes through the ribs 14*a*, resulting in noise and reducing the heat dissipating efficiency.

OBJECTS OF THE INVENTION

An object of the present invention is to provide a heat dissipating fan with an air concentrating effect.

Another object of the present invention is to provide a heat dissipating fan with an airflow guiding effect.

A further object of the present invention is to provide a heat dissipating fan with lowered blowing noise.

Still another object of the present invention is to provide a heat dissipating fan with improved heat dissipating efficiency.

Yet another object of the present invention is to provide a heat dissipating fan with increased design flexibility.

Still another object of the present invention is to provide a heat dissipating fan with added additional value.

SUMMARY OF THE INVENTION

In accordance with an aspect of the present invention, a heat dissipating fan comprises a casing having an outlet, a base mounted in the outlet of the casing, and a plurality of air guiding members mounted in the outlet and connected between the base and the casing. Each air guiding member defines at least one air concentrating area for concentrating air, for guiding airflow, and for increasing wind pressure when an impeller mounted on the base turns.

The air concentrating area is defined between each air guiding member and the casing, between each air guiding member and the base, and/or between two of the air guiding members adjacent to each other.

In an embodiment, the air concentrating area is delimited by a plurality of inclined faces on each air guiding member, and each air guiding member is substantially H-shaped.

In another embodiment, each air guiding member includes a V-shaped section with two inclined faces when viewed from the air flowing direction.

In a further embodiment, each air guiding member includes an arc portion having two ends connected to the casing. Each air guiding member further includes a rectilinear portion connected between the base and an intermediate section of the arc portion. Each rectilinear portion may have an inclining angle corresponding to an inclining angle of a plurality of blades of the impeller.

In still another embodiment, each air guiding member is substantially y-shaped and includes a first rectilinear portion connected between the base and the casing and a second rectilinear portion connected between an intermediate section of the first rectilinear portion and the casing.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
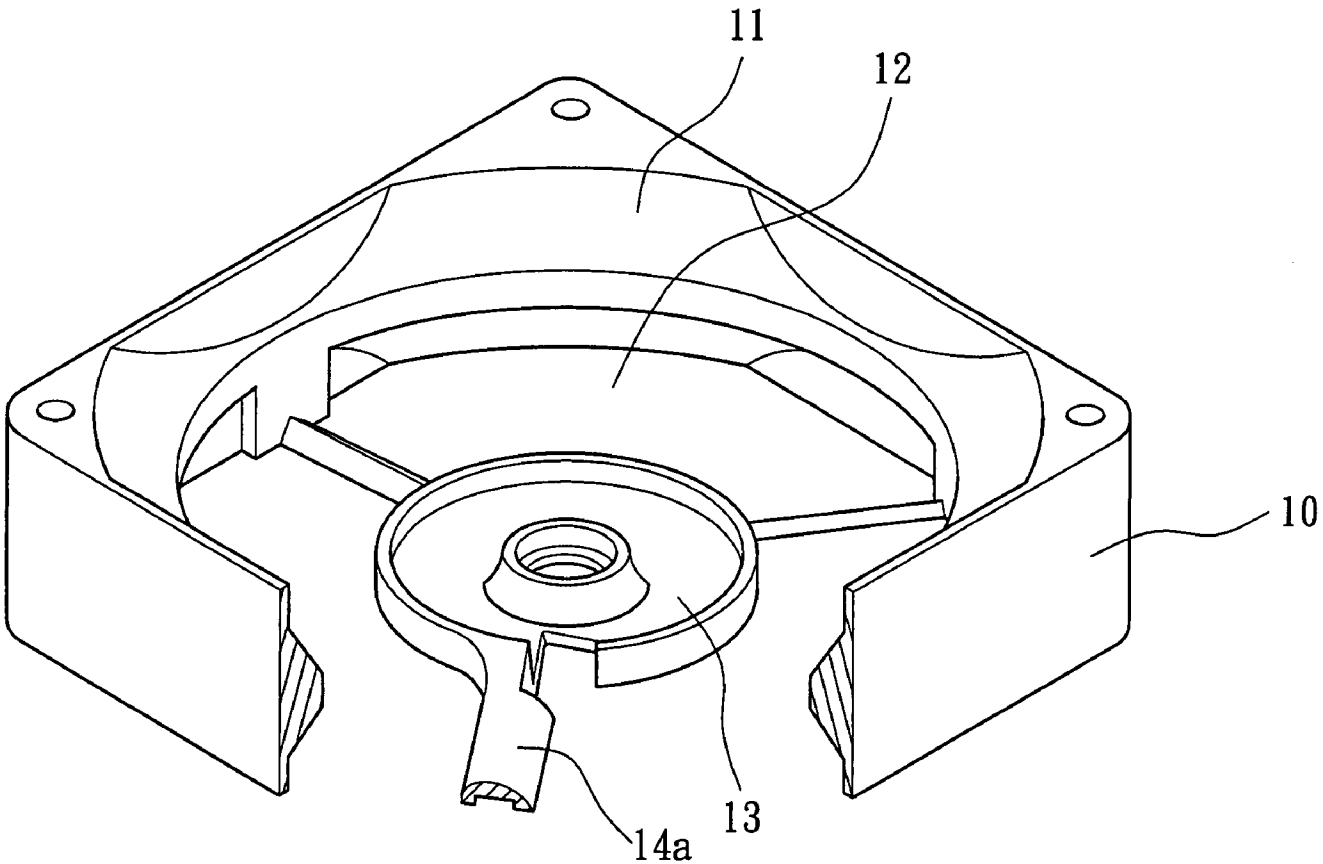
FIG. 1 PRIOR ART
FIG. 1 is a perspective view, partly cutaway, of a conventional heat dissipating fan.

Preferred embodiments of the present invention are now to be described hereinafter in detail, in which the same reference numerals are used in the preferred embodiments for the same parts as those in the prior art to avoid redundant description.

Figure 2:
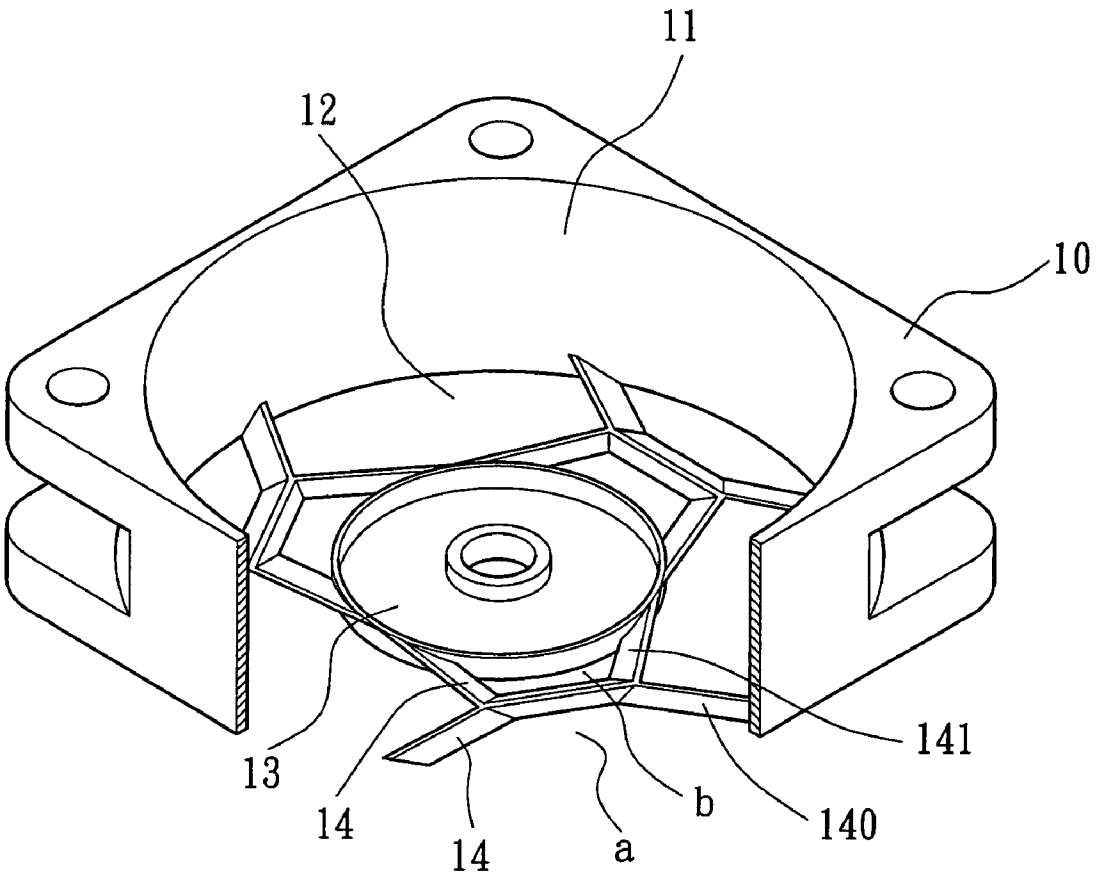
FIG. 2 is a perspective view, partly cutaway, of a first embodiment of a heat dissipating fan in accordance with the present invention.
Figure 3:
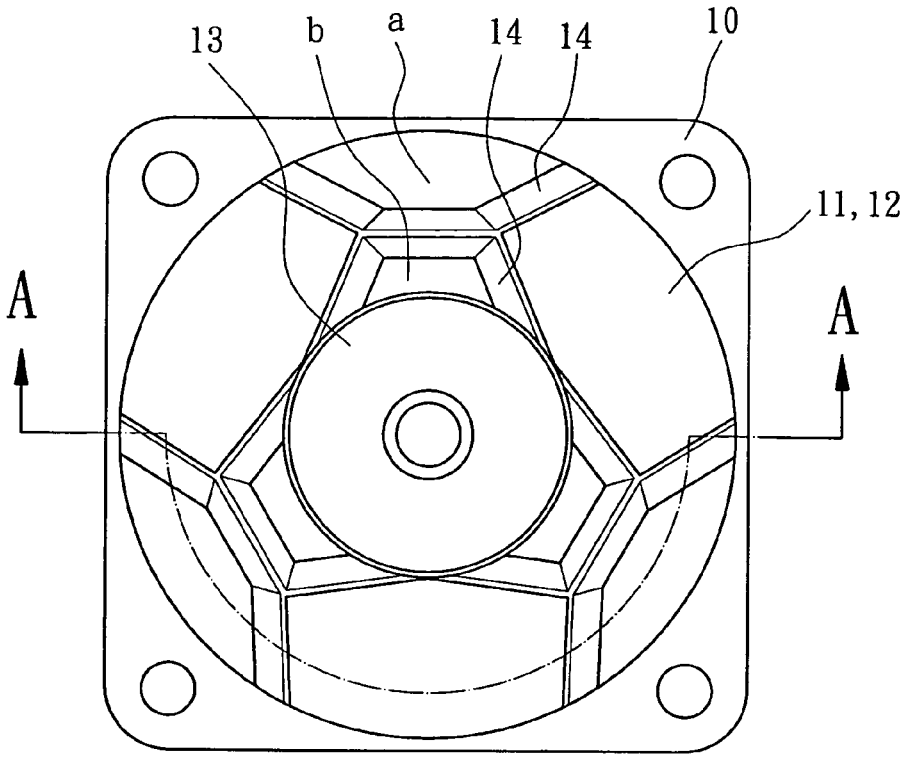
FIG. 3 is a top view of the heat dissipating fan in FIG. 2.
Figure 4:
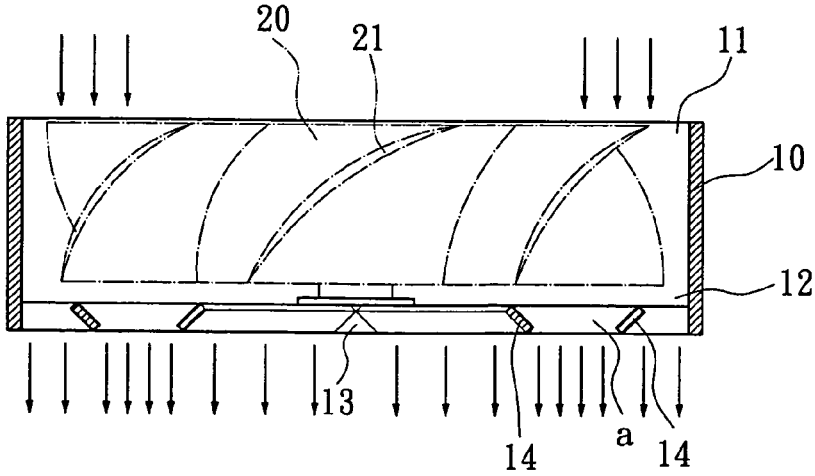
FIG. 4 is a sectional view taken along plane A—A in FIG. 3.

Referring to FIG. 2 through 4, a first embodiment of a heat dissipating fan in accordance with the present invention comprises a casing 10, a base 13, and a plurality of air-guiding member 14. The casing 10 is made of plastics or metal, with an inlet 11 and an outlet 12 being respectively defined in two sides of the casing 10. The base 13 is mounted to the outlet side of the casing 10. An impeller 20 (FIG. 4) is mounted on the base 13 for driving air. The air guiding members 14 are connected between the casing 10 and the base 13. Each air guiding member 14 defines at least one air concentrating area "a".

In this embodiment, each air guiding member 14 is substantially H-shaped, with a first air concentrating area "a" being defined between each air guiding member 14 and the casing 10 and with a second air concentrating area "b" being defined between each air guiding member 14 and the base 13. The first air concentrating area "a" is not communicated with the second air concentrating area "b".

Each air guiding member 14 includes a plurality of first inner inclined faces 140 that delimit the first air concentrating area "a". Each air guiding member 14 further includes a plurality of second inner inclined faces 141 that delimit the second air concentrating area "b". The inner inclined faces guides airflow into the first and second air concentrating areas "a" and "b" to obtain the required air concentrating effect. The first inner inclined faces delimiting the first air concentrating area "a" have an inclining angle the same as or different from that of the second inner inclined faces. Further, the casing 10, the base 13, and the air guiding members 14 can be integrally formed or assembled together.

As illustrated in FIG. 4, when the impeller 20 turns, blades 21 of the impellers 20 draws air into the casing 10 via the inlet 11 and outputs air via the outlet 12 for dissipating an object such as a fin or a central processing unit. When the airflow passes through the air guiding members 14 in the outlet 12, the inclined faces on the air guiding members 14 smoothly guide the airflow into the first and second air concentrating areas "a" and "b" to thereby dissipate an object directly below the first and second concentrating areas "a" and "b". Further, the sectional area of each of the first and second concentrating areas "a" and "b" adjacent to the outlet side of the casing 10 is reduced by the provision of the inclined faces, thereby increasing the wind pressure. Further, the inclined faces reduce the risk of generation of turbulent when the airflow passes through the air guiding members 14. The blowing noise is thus lowered.

Further, since the air guiding members 14 are capable of concentrating air and guiding the direction of the airflow in a desired manner, the heat dissipating fan can be mounted in a limited space in, e.g., a notebook type computer. The airflow can be directed to an object (such as a fin) located in a specific place right below the outlet 12 (such as a place below at least one of the first and second concentrating areas "a" and "b"). If desired, the inclining angle of the inclined faces 140 delimiting the first concentrating area "a" is different from that of the inclined faces 141 delimiting the second concentrating area "b" to provide different pressurizing effects. Further, the H-shaped air guiding members 14 provide a decorative effect as well as an aesthetically pleasing effect to the heat dissipating fan, adding additional value to the heat dissipating fan.

Figure 5:
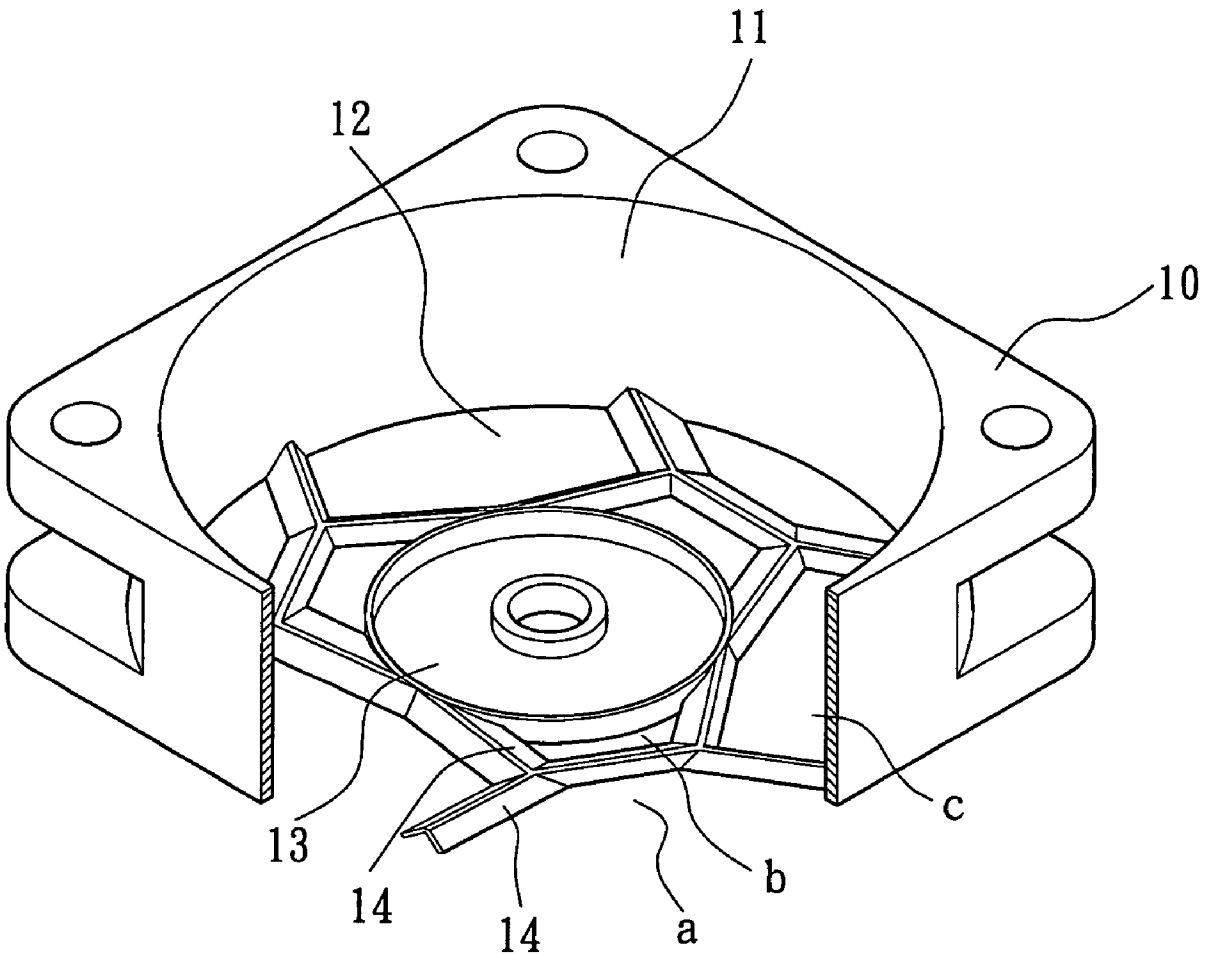
FIG. 5 is a perspective view, partly cutaway, of a second embodiment of the heat dissipating fan in accordance with the present invention.
Figure 6:
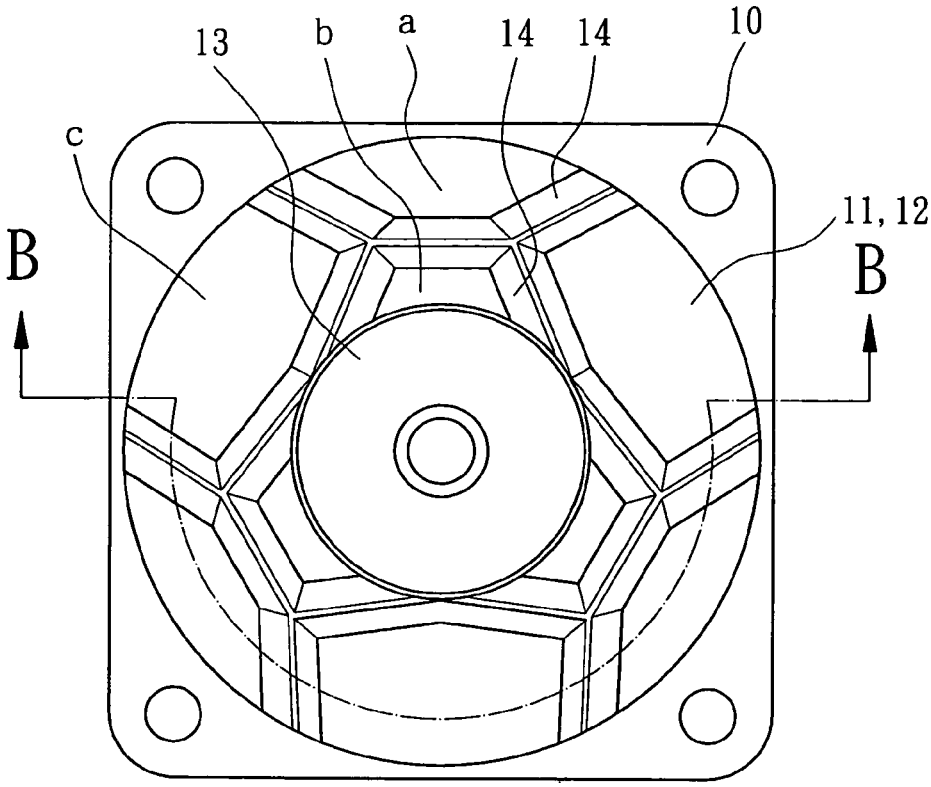
FIG. 6 is a top view of the heat dissipating fan in FIG. 5.
Figure 7:
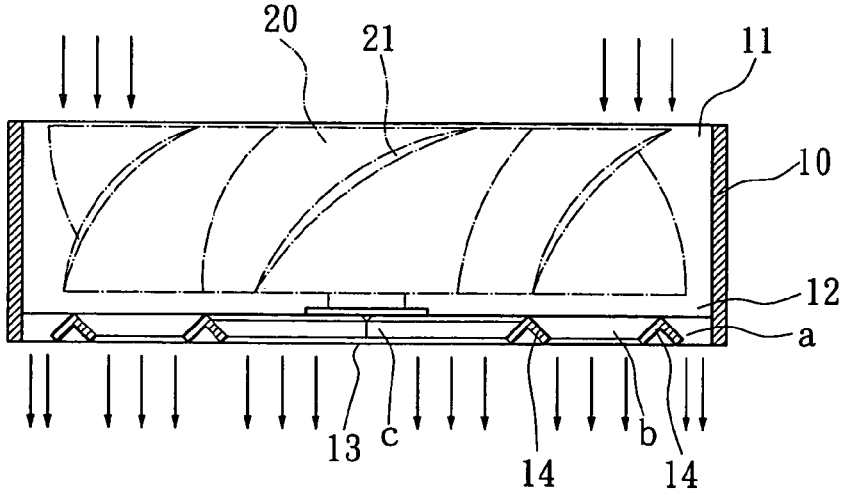
FIG. 7 is a sectional view taken along plane B—B in FIG. 6.

FIGS. 5 through 7 illustrate a second embodiment of the present invention, wherein each air guiding member 14 includes a V-shaped section with two inclined faces when viewed from the air flowing direction. Further, a third air concentrating area "c" is defined between each two air guiding members 14 adjacent to each other. An air concentrating effect is smoothly provided, the direction of airflow is smoothly changed, the wind pressure is increased, and the blowing noise is lowered.

Figure 8:
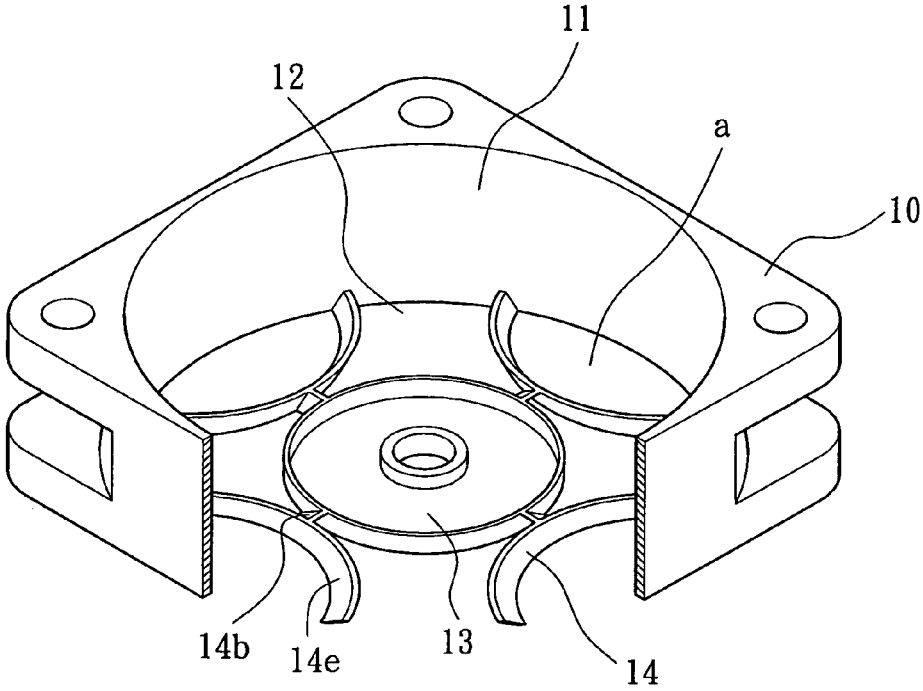
FIG. 8 is a perspective view, partly cutaway, of a third embodiment of the heat dissipating fan in accordance with the present invention.
Figure 9:
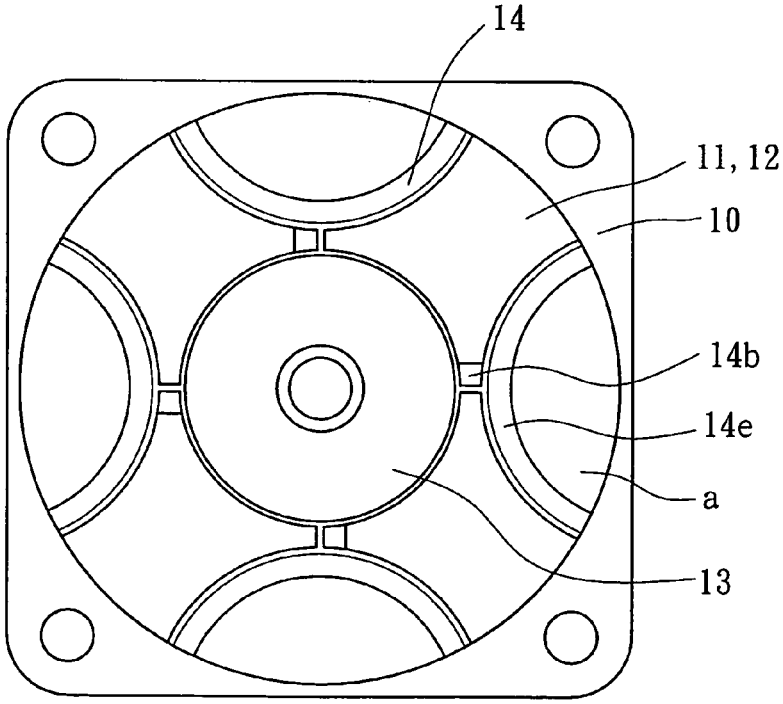
FIG. 9 is a top view of the heat dissipating fan in FIG. 8.

FIGS. 8 and 9 illustrate a third embodiment of the present invention, wherein each air guiding member 14 includes an arc portion 14*e* having two ends connected to the casing 10 and a rectilinear portion 14*b* connected between the base 13 and an intermediate section of the arc portion 14*e*. An air concentrating area "a" is defined between each air guiding member 14 and the casing 10. Preferably, each rectilinear portion 14*b* has an inclining angle corresponding to the inclining angle of the blades 21 of the impeller 20. This embodiment provides features the same as those of the above embodiments.

Figure 10:
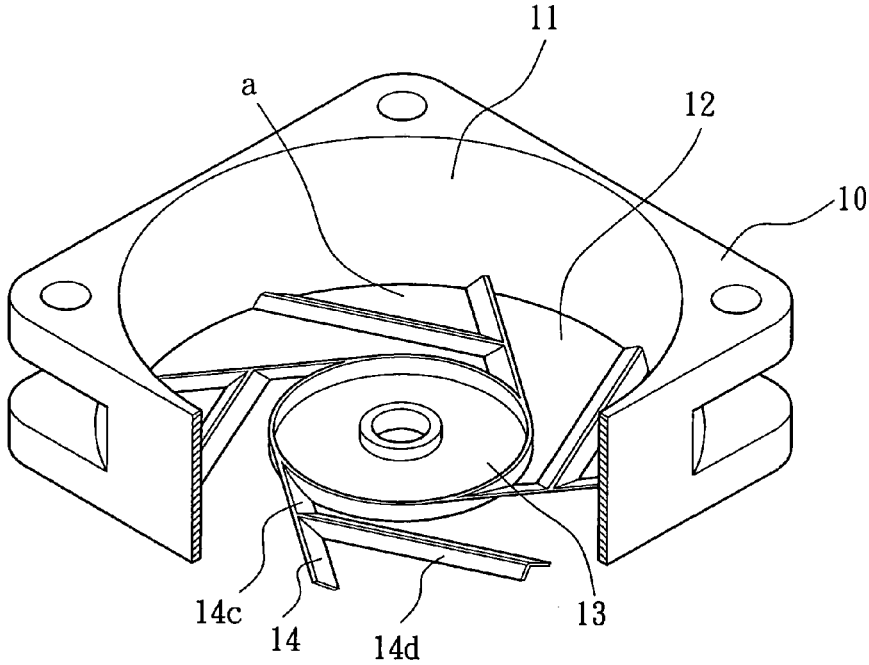
FIG. 10 is a perspective view, partly cutaway, of a fourth embodiment of the heat dissipating fan in accordance with the present invention.
Figure 11:
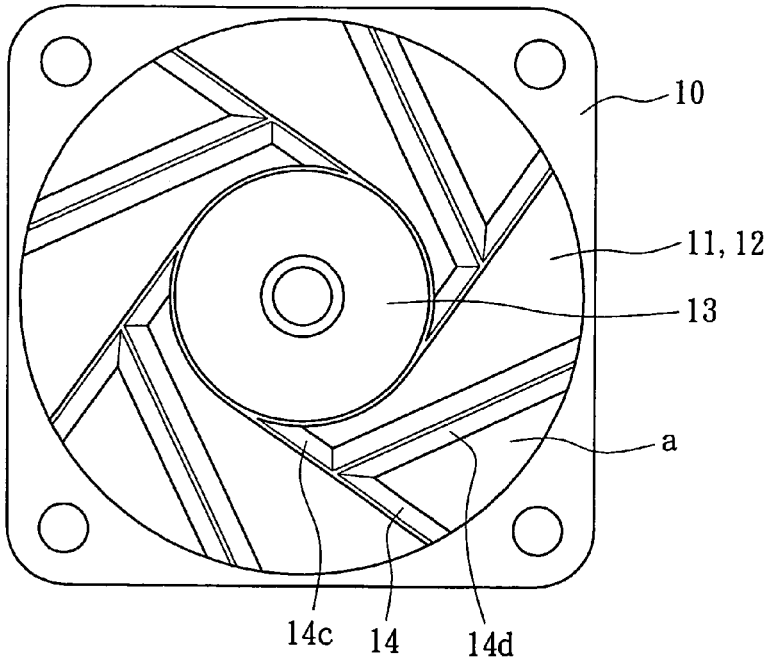
FIG. 11 is a top view of the heat dissipating fan in FIG. 10.

FIGS. 10 and 11 illustrate a fourth embodiment of the present invention, wherein each air guiding member 14 is substantially y-shaped and includes a first rectilinear portion 14*c* connected between the base 13 and the casing 10 and a second rectilinear portion 14*d* connected between an intermediate section of the first rectilinear portion 14*c* and the casing 10. A substantially triangular air concentrating area "a" is defined between each air guiding member 14 and the casing 10. Preferably, each second rectilinear portion 14*d* has an inclining angle corresponding to the inclining angle of the blades 21 of the impeller 20. This embodiment provides features the same as those of the above embodiments.

The design flexibility of the heat dissipating fan is increased, as the designer may choose the desired shapes for the air guiding members 14.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A heat dissipating fan comprising:

a casing including an outlet;

a base mounted in the outlet of the casing; and at least one air guiding member mounted in the outlet and located between the base and the casing, said air guiding member defining at least one air concentrating area for concentrating air, for guiding airflow, and for increasing wind pressure, wherein said air guiding member includes an arc portion having two ends connected to the casing.

2. The heat dissipating fan as claimed in claim 1, wherein said air concentrating area is defined between said air guiding member and the casing.

3. The heat dissipating fan as claimed in claim 1, wherein said air concentrating area is defined between said air guiding member and the base.

4. The heat dissipating fan as claimed in claim 2, wherein said air concentrating area is delimited by a plurality of inclined faces of said air guiding member.

5. The heat dissipating fan as claimed in claim 3, wherein said air concentrating area is delimited by a plurality of inclined faces of said air guiding member.

6. The heat dissipating fan as claimed in claim 1, wherein said air concentrating area is defined between two air guiding members adjacent to each other.

7. The heat dissipating fan as claimed in claim 1, wherein said air concentrating area is delimited by a plurality of inclined faces of said air guiding member.

8. The heat dissipating fan as claimed in claim 1, wherein said air guiding member includes a V-shaped section with two inclined faces.

9. The heat dissipating fan as claimed in claim 1, wherein said air guiding member further includes a rectilinear portion connected between the base and an intermediate section of the arc portion.

10. The heat dissipating fan as claimed in claim 9, wherein each said rectilinear portion has an inclining angle corresponding to an inclining angle of a blade of an impeller.

11. A heat dissipating fan comprising:

a casing including an outlet;

a base mounted in the outlet of the casing; and at least one air guiding member mounted in the outlet and located between the base and the casing, said air guiding member defining at least one air concentrating area for concentrating air, for guiding airflow, and for increasing wind pressure, wherein each said air guiding member is substantially H-shaped.

12. The heat dissipating fan as claimed in claim 11, wherein said air concentrating area is defined between said air guiding member and the casing, or between said air guiding member and the base.

13. The heat dissipating fan as claimed in claim 11, wherein said air concentrating area is delimited by a plurality of inclined faces of said air guiding member.

14. The heat dissipating fan as claimed in claim 11, wherein said air guiding member includes a V-shaped section with two inclined faces.

15. A heat dissipating fan comprising:

a casing including an outlet;

a base mounted in the outlet of the casing; and at least one air guiding member mounted in the outlet and located between the base and the casing, said air guiding member defining at least one air concentrating area for concentrating air, for guiding airflow, and for increasing wind pressure, wherein said air guiding member is substantially y-shaped.

16. The heat dissipating fan as claimed in claim 15, wherein said air guiding member includes a first rectilinear portion connected between the base and the casing and a second rectilinear portion connected between an intermediate section of the first rectilinear portion and the casing, and said second rectilinear portion has an inclining angle corresponding to an inclining angle of a blade of an impeller.

17. The heat dissipating fan as claimed in claim 15, wherein said air guiding member includes a first rectilinear portion connected between the base and the casing and a second rectilinear portion connected between an intermediate section of the first rectilinear portion and the casing.

18. The heat dissipating fan as claimed in claim 15, wherein said air concentrating area is defined between said air guiding member and the casing, or between said air guiding member and the base.

19. The heat dissipating fan as claimed in claim 15, wherein said air concentrating area is delimited by a plurality of inclined faces of said air guiding member.

20. The heat dissipating fan as claimed in claim 15, wherein said air guiding member includes a V-shaped section with two inclined faces.

* * * * *